US005692996A

United States Patent [19]

Widerman

[11] Patent Number: 5,692,996

[45] Date of Patent: Dec. 2, 1997

[54] SCULPTED WEIGHT FOR PHYSICAL FITNESS ROUTINES

[76] Inventor: Paul Widerman, 134 Rochester Center Rd., Accord, N.Y. 12404

[21] Appl. No.: 540,577

[22] Filed: Oct. 6, 1995

[51] Int. Cl.[6] ..... A63B 21/06

[52] U.S. Cl. ..... 482/93; 482/106; 482/108; 482/140; 482/148

[58] Field of Search ..... 482/92, 93, 98, 482/105, 106, 108, 139, 140, 141, 148; D21/196, 197

[56] References Cited

U.S. PATENT DOCUMENTS

| | | | |
|---|---|---|---|
| D. 244,628 | 6/1977 | Wright | D21/197 |
| D. 274,283 | 6/1984 | Wright . | |
| D. 299,373 | 1/1989 | Parker et al. | D21/196 |
| D. 355,007 | 1/1995 | Rojas et al. | D21/196 |
| 1,047,212 | 12/1912 | Hamilton . | |
| 2,163,107 | 6/1939 | Shatto et al. | 482/105 |
| 3,572,702 | 3/1971 | Dorn . | |
| 3,771,785 | 11/1973 | Speyer . | |
| 3,796,431 | 3/1974 | Sinyard . | |
| 3,862,768 | 1/1975 | England | 482/146 |
| 3,895,794 | 7/1975 | England | 482/146 |
| 4,079,932 | 3/1978 | Schuertz . | |
| 4,191,371 | 3/1980 | Armor, Jr. | 482/146 |
| 4,373,717 | 2/1983 | Lambert, Jr. . | |
| 4,515,364 | 5/1985 | Rotella | 482/93 |
| 4,673,179 | 6/1987 | Pengler | 482/93 |
| 4,714,246 | 12/1987 | Parisien | 482/110 |
| 4,789,270 | 12/1988 | Selisky | 482/105 |
| 4,898,380 | 2/1990 | Kobrin | 482/93 |
| 4,995,604 | 2/1991 | Lynch et al. | 482/93 |
| 5,137,502 | 8/1992 | Anastasi . | |
| 5,169,372 | 12/1992 | Tecco | 482/140 |

*Primary Examiner*—Stephen R. Crow
*Assistant Examiner*—Victor K. Hwang
*Attorney, Agent, or Firm*—Levine & Mandelbaum

[57] ABSTRACT

The sculpted weight was designed for use in a weight lifting routine developed by the inventor. The weight facilitates: 1) the doing of "new" weight lifting exercises 2) the doing of traditional weight lifting exercises. Further, it's unique design encourages the user to experiment and be creative while exercising (12). The exercise routine developed by the inventor encompasses an aerobic weight lifting circuit which includes a rotational arm and shoulder exercise as well as more traditional weight lifting exercises. To facilitate the routine the weight is elliptically shaped (12). Further, the weight curves simultaneously in two directions at once (26) (28); has two hand holes for gripping (12); has a center hole for cupping the head in exercises like sit-ups and as a means for storage (16). The unique shape of the weight allows it to conform to the body when necessary and remain aerodynamically comfortable and balanced when in use and in motion.

13 Claims, 5 Drawing Sheets

SCULPTED WEIGHT FOR PHYSICAL FITNESS ROUTINES

BACKGROUND—FIELD OF INVENTION

The subject of the invention relates generally to physical fitness equipment; and, specifically to a sculpted weight which has hand grips and is used for both innovative and traditional exercise routines.

BACKGROUND—DESCRIPTION OF PRIOR ART

When the benefits of circuit and aerobic weight training became apparent as a training practice in the world of athletics and physical fitness, the inventor devised a weight training routine that could be done by grasping a simple barbell plate on opposite sides and then moving the weight through an aerobic weight lifting routine. Barbell plates generally come in increments of 2.5, 5, 10, 25, 35, and 45 pounds; and thus, one could pick the size plate that was appropriate for one's strength and the routine. As the routine evolved, and unique exercises were developed, the inventor sought to design and develop a special weight that could be used for doing the routine. The two most obvious solutions to the problem were: 1) to cut hand holes in a barbell plate, or 2) to add handles onto a barbell plate.

The first solution as presented by Anastasi, "Weight for Physical Fitness Having an Integrally Made Handle", U.S. Pat. No. 5,137,502, (Aug. 1992) does not work for two reasons. The first problem is Anastasi's weight, like the barbell, is still flat. Thus, the weight does not conform to the natural shape of the body in the exercises where this is required. (In fact, Anastasi's weight is designed so that it can be used as a barbell.). Secondly, because of Anastasi's weight's disc shape (circular), and the removal of mass for the two hand grips, the weight becomes top heavy in the two directions where no mass was removed. Thus, it is not balanced properly for the "new" exercises of the routine.

Although there is no prior an for the second solution, adding handles to a disc, there still would remain the problem of flatness. In this case the weight would be out of balance in the direction of the added mass-the handles.

And thus, it became necessary to develop a new and unique shape that solved the two problems of: 1) conforming to the shape of the body when necessary, and 2) allowing the user to maximally maintain balance while doing the dynamic new exercises of the routine.

OBJECTS AND ADVANTAGES

The objects and advantages of the present invention are:

a) to provide a single weight that can be grasped in two hands and used for an exercise routine;

b) to remain in balance during dynamic exercise movements, some of which are traditional, and some that are unique;

c) to conform to the shape of the body when this facilitates doing the exercise;

d) to be inexpensive, small, and enable a person to exercise every major muscle group in a dynamic way that will translate into muscles that are stronger for coordinated movements;

e) to allow the user to do the entire routine, exercising every major muscle group, without having to put down the weight for different exercises;

f) to allow the user to develop fluidity, coordination, and strength in one weight lifting routine, as opposed to isolating muscle groups which develop only one muscle at a time;

g) to allow the user to develop aerobic and anaerobic fitness, as well as fluidity, coordination, and flexibility-all at the same time;

h) to have the weight come in different weight increments so that the user can use a heavier version as he/she becomes stronger;

i) to have a means by which the weight could be stored and easily lifted from the storage position to the position of usage.

All of these objectives and advantages are accomplished by providing a weight that has been specifically sculpted to satisfy these criteria. In a plan view, the weight is elliptically shaped with two hand holes, one at each end of the ellipse. A hole in the center is used to cup the head for appropriate exercises, (like sit-ups), and is used to store the weight on a storage device.

However, the most distinguishing feature of the weight is the unique curvature of its form. This is apparent in the perspective, plan, and section views.

The front face of the weight is curved, in a generally concave manner, about the vertical axis of the weight, i.e., the axis which is vertical when the weight is being held in front of the user with both hands and with the front face of the weight facing the user. The rear face of the weight is curved, in a generally concave manner, about the horizontal axis of the weight, i.e., the axis which is horizontal when the weight is being held in front of the user with both hands and with the rear face of the weight facing away from the user. The extreme ends of the weight, at the hand grips, may be turned slightly back away from the front face of the weight.

The full benefits and advantages of this weight will become further apparent from the drawings of both the object itself and the illustrations of some of the possible ways it is used in practice.

DRAWING FIGURES

Both the form of the weight and the exercise routines it was designed to facilitate are believed to be unique. The drawings are essential for an understanding of both the form of the object and some of the ways in which it can be used.

DESCRIPTION—FIGS. 1–3

Figure 1:
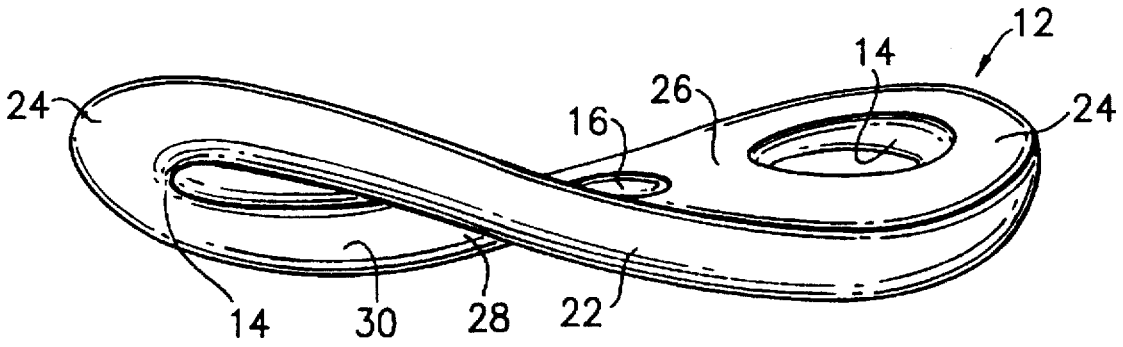
FIG. 1 is a perspective view of a preferred embodiment of the present invention.
Figure 2:
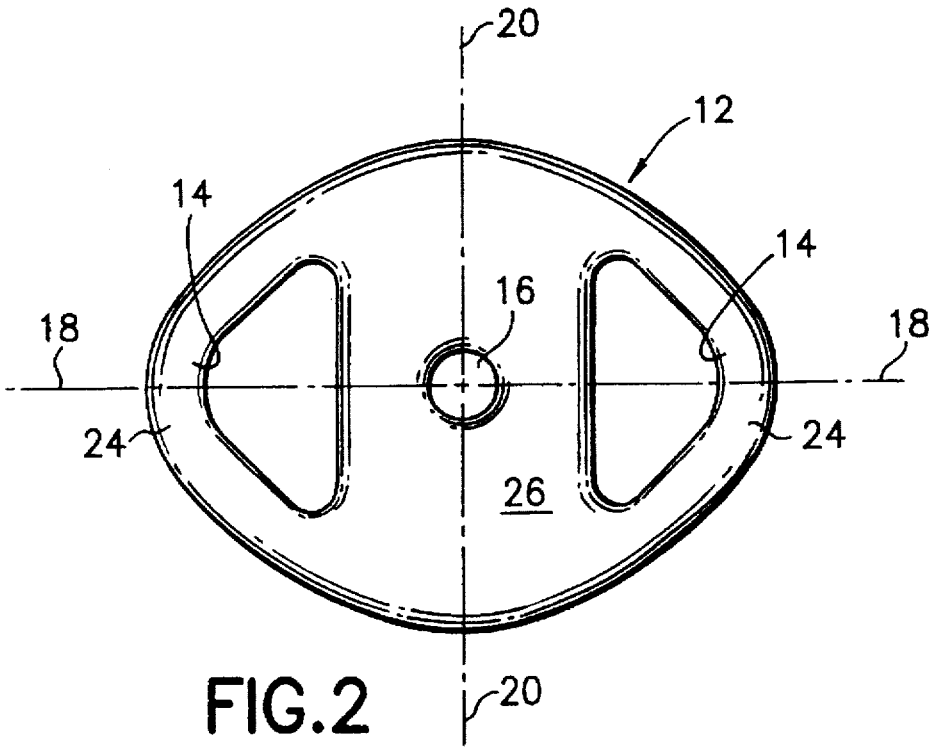
FIG. 2 is a plan view of the preferred embodiment.
Figure 3:
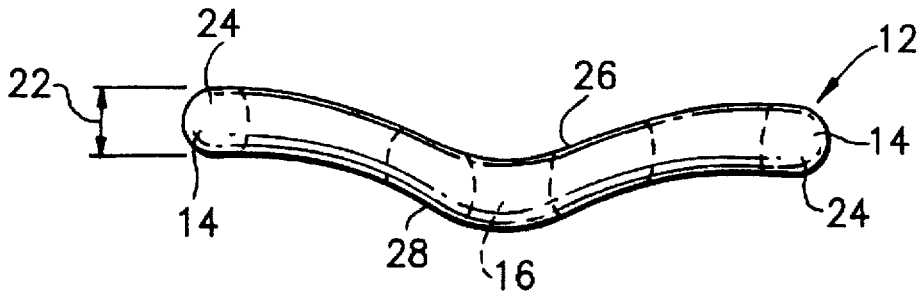
FIG. 3 is an end view along the vertical axis of the preferred embodiment.

The following description will enable any person to make and use the invention as envisioned by the inventor. FIG. 1 shows a perspective view of a basic version of the sculpted weight. FIG. 2 shows a plan view. FIG. 3 shows an end view along the horizontal axis.

As seen in FIG. 1, the weight 12 is elliptically shaped and has two hand grips 14 diametrically opposed toward the outer poles of the ellipse. In the center is a hole 16 which is at the center of gravity on both the horizontal and vertical axes in the plan view. Though the exact dimensions may vary, in a preferred embodiment the horizontal axis 18 (FIG. 2) would be 13" and the vertical axis 20 11" in the plan view. The thickness 22 (FIGS. 1A and 3) of the weight would vary depending on its mass and the preferences of the user, but should be approximately 0.75 to 1.5 inches with the circumference of the hand grips 24 approximately 6".

The most important and distinguishing feature of the sculpted weight is its unique form. The weight is curved in two different directions simultaneously.

The front face 26 (FIGS. 1–4) of the weight is curved, in a generally concave manner, about the vertical axis 20 (FIG. 2) of the weight. The rear face 28 (FIGS. 1 and 3) of the weight is curved, in a generally concave manner, about the horizontal axis 18 of the weight. The extreme ends 24 of the weight, at the hand grips 14, may be turned slightly back (see FIG. 3) away from the front face 26.

In a preferred embodiment the center storage opening, which also cups the head in some exercises, is 1.5" in diameter 16. The hand grips are 5.5" long and 2.25" wide 14. However, these dimensions may vary slightly.

The weight could be made of a suitable metal wood, plastic, or rubber, and covered with a soft neoprene type material vinyl, rubber or chrome plating, making it comfortable to hold and handle-and less likely to do damage if dropped. It could also be made of a plastic shell and filled with a suitable substance to give it greater mass.

OPERATION—FIGS. 4, 5, 6, 7, 8, 9

Figure 4:
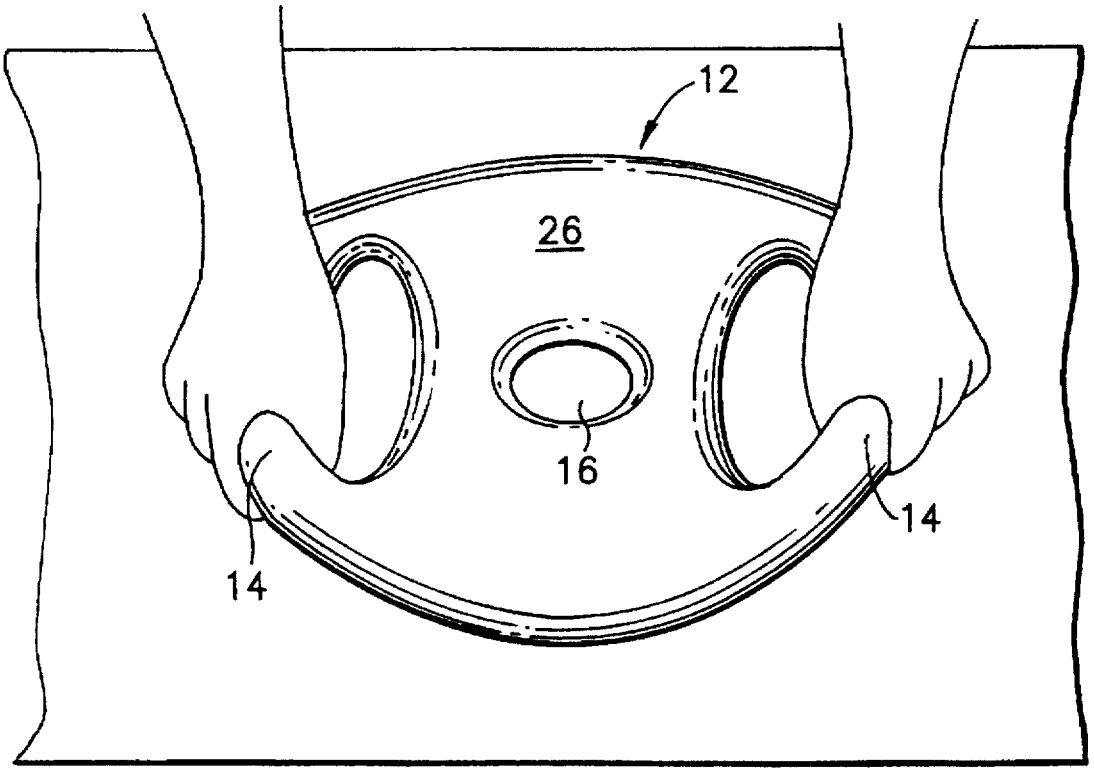
FIG. 4 shows how to pick up the weight from a flat surface.
Figure 5A:
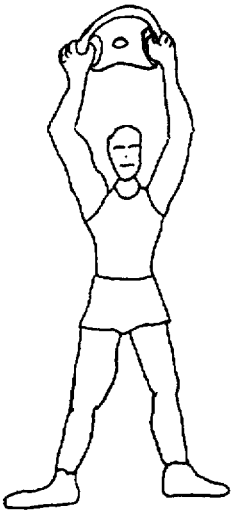
FIG. 5 shows the weight used in a rotational arm and shoulder routine, (one of the new exercises for which it was invented)
Figure 5B:
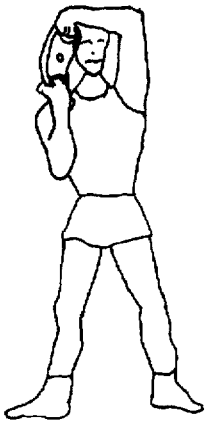
Figure 5C:
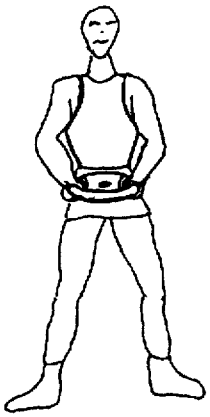
Figure 5D:
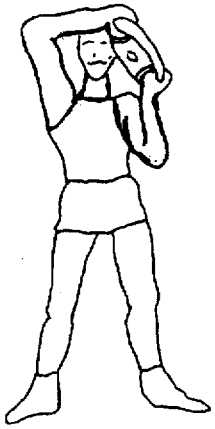
Figure 5E:
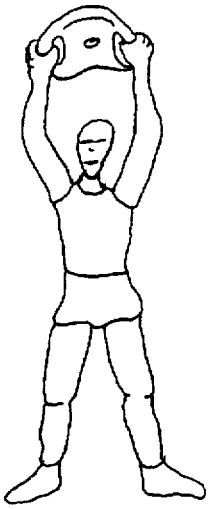

Some of the exercise movements for the sculpted weight require practice to perform properly. However, FIGS. 4, 5, 6, 7, 8, 9 illustrate ways to use the sculpted weight. FIG. 4 shows how to pick up the weight from a flat surface. FIG. 5 is an exercise believed to be novel and developed by the inventor (the weight was created first and foremost to do this exercise). FIGS. 6, 7, 8, 9, show the weight used in the more traditional exercises of lunges, sit-ups, bench presses, and squats, respectively.

Figure 6A:
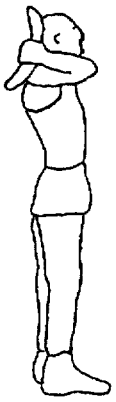
FIG. 6 shows the weight used for the traditional exercise of lunging.
Figure 6B:
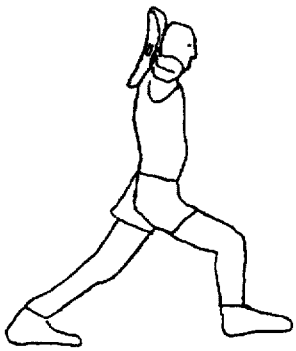
Figure 6C:
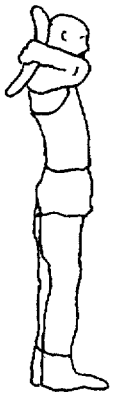
Figure 7A:
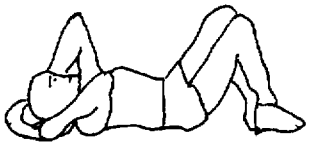
FIG. 7 shows the weight used for the traditional exercise of sit-ups.
Figure 7B:
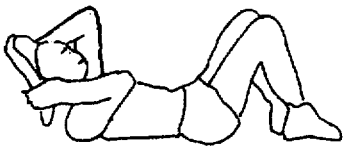
Figure 7C:
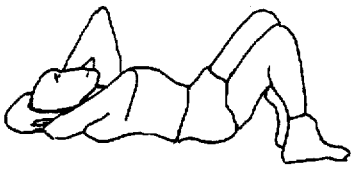
Figure 8A:
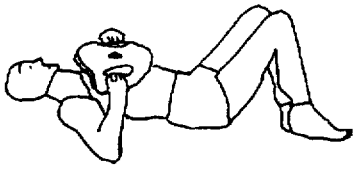
FIG. 8 shows the weight used for the traditional exercise of bench pressing.
Figure 8B:
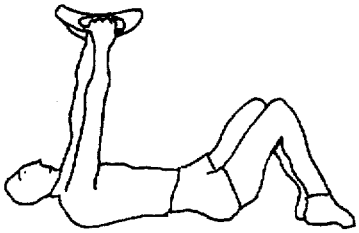
Figure 8C:
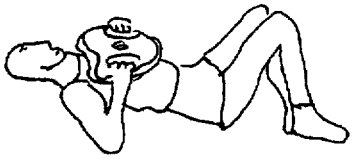
Figure 9A:
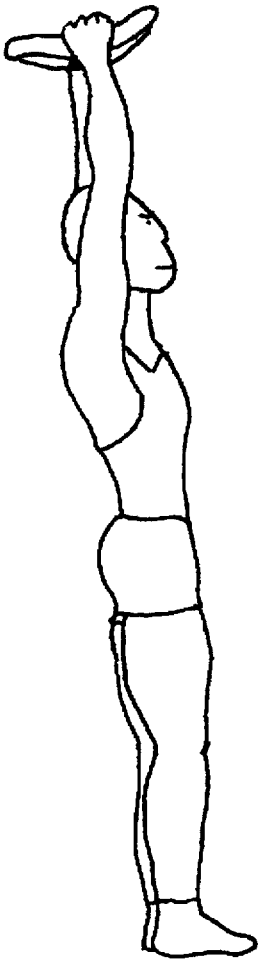
FIG. 9 shows the weight used for the traditional exercise of squats.
Figure 9B:
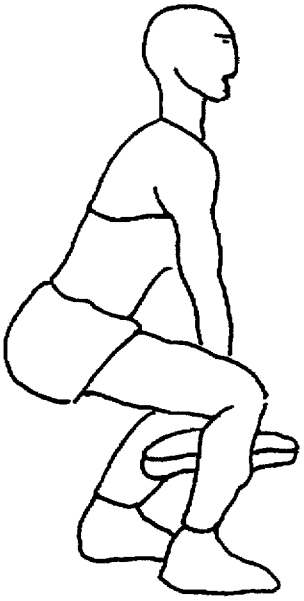
Figure 9C:
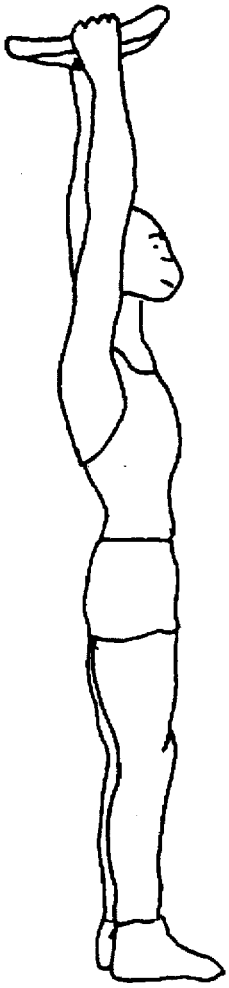

To use the weight, one picks it up through each of the hand grips which are slightly raised from the supporting surface because of the weight is curvature, FIG. 4. At this point there are many possible exercises: FIG. 5 shows a unique rotational arm and shoulder exercise (for which the weight was invented) that builds strength, coordination and fluidity, as well as embodying Tai Chi type moments. The exercise is performed by moving the weight 12 from a starting position above the head with the arms substantially extended, FIG. 5A, to a lower position with the arms substantially extended, FIG. 5C, the weight 12 passing to the front and side of the upper torso, FIG. 5B, and returning the weight 12 to the upper position, FIG. 5E, with the weight 12 passing to the front and opposite side of the upper torso, FIG. 5D. FIG. 6 shows how the weight conforms to the neck and back of the head for lunge exercises. The lunge exercise is performed by placing the weight 12 behind the neck such that the back of the neck rests within the vertical concave curve 26 while in a standing position, FIG. 6A, stepping forward with one leg, FIG. 6B, and returning to the standing position, FIG. 6C. FIG. 7 shows how the weight conforms to the back of the head for sit-ups. The sit-up exercise is performed from a supine position with the weight 12 in a lowered position behind the neck such that the back of the neck rests within the vertical concave curve 26, FIG. 7A, performing a sit-up movement while keeping the weight 12 behind the neck, FIG. 7B, and returning to the lowered position, FIG. 7C. FIG. 8 shows how the weight conforms to the chest for bench pressing. The bench press exercise is performed from a supine position with the weight 12 in a lowered position above the chest, FIG. 8A, pressing the weight 12 to a raised position above the chest, FIG. 8B, and returning the weight 12 to the lowered position, FIG. 8C. FIG. 9 shows how the weight can be used to do squats (one lets it fall in circle from above the head to a low point between the legs). The squat exercise is performed from a standing position with the weight 12 located above the head and arms extended, FIG. 9A, moving the weight 12 to a lower position between the legs with arms extended and knees bent, FIG. 9B, and returning the weight 12 to the raised position, FIG. 9C.

SUMMARY, RAMIFICATIONS AND SCOPE

The preferred embodiment of the present invention provides an elliptically shaped weight with two diametrically opposed hand holes and a center hole. Furthermore, the weight has a unique form, best described as simultaneously curving in two directions at once. This allows the weight to conform to the body when necessary, and remain aerodynamically comfortable and balanced when in use and in motion.

Although the description above contains many specificities, these should not be considered as limiting the scope of the invention but as merely providing illustrations of the presently preferred embodiment of this invention. For example, it is not necessary that the center hole be circular, or there even be an actual hole for the invention to work. Also, the weight could have a means to add mass integrally in the region of its center of gravity. Or, weights could also be added by attaching them externally to the form. Those skilled in manufacture and use will appreciate the infinite possibilities of this exercise weight and the various adaptations and modifications that can be made without departing from the essential essence of the invention.

Thus, the scope of the invention should be determined by the appended claims and their legal equivalents, rather than by the examples given.

I claim:

1. An exercise weight comprising:

a body having a generally flattened, elongated shape;

said body having a front face, a back face, a vertical axis, and a horizontal axis;

the vertical axis corresponding to a short axis of the body;

the horizontal axis corresponding to a long axis of the body;

a pair of generally diametrically opposed hand grips located along the horizontal axis of the body said grips including means adapted to be grasped by the user's hands to distinguish that the hand grips are specifically provided for gripping by the user'hands;

the body being curved, in a generally concave manner relative to the front face, about the vertical axis of the body, and to describe that the entire body of the weight is curved about the vertical axis rather than merely the front face having a concave curve about the vertical axis, the body being curved, in a generally concave manner relative to the back face, about the horizontal axis of the body to describe that the entire body of the weight is curved about the horizontal axis rather than merely the back face having a concave curve about the horizontal axis.

2. An exercise weight as defined in claim 1 wherein the body has a substantially elliptical shape.

3. An exercise weight as defined in claim 1 wherein the hand grips are defined by hand holes in the body.

4. An exercise weight as defined in claim 1 wherein the rear face of the body is curved, in a generally concave manner, about the two axes parallel to, but spaced from the vertical axis, each of said two axes being adjacent to one of said hand grips.

5. An exercise weight as defined in claim 1 wherein said body is made of a material selected from the group consisting of metal, wood, plastic and rubber.

6. An exercise weight as defined in claim 1 wherein said body is covered by a protective material selected from the group consisting of neoprene, vinyl, rubber, and chrome plating.

7. An exercise weight as defined in claim 1 wherein said body further comprises a central aperture located at the center of said body, said central aperture providing a means for supporting the head of the user when the head of the user is engaged to said weight during an exercise routine and said central aperture also providing a means for storing said weight.

8. An exercise weight as defined in claim 1 wherein the front face of the body is formed with a depression at its center, the depression serving to accommodate the head of the user when the user is engaged in an exercise routine.

9. A method of using the weight of claim 1 comprising the steps of:

the user, in a standing position, grasping each of the hand grips of the weight with a respective hand;

positioning the weight above the head in an uppermost position, wherein the arms are extended substantially upward; and moving the weight in a substantially arcuate path by lowering the weight to the front and side of the body to a lower position, wherein the arms are substantially extended downward, and then raising the weight to the front and opposite sides of the body to the uppermost position, whereby the dynamic movement of the weight exercises muscles of the body.

10. A method of using the weight of claim 1 comprising the steps of:

the user, in a standing position, grasping each of the hand grips of the weight with a respective hand;

placing the weight behind the head and neck region such that the user's neck rests within the concave curve of the front face of the body;

the user performing a lunge movement by stepping forward with one leg while keeping the weight behind the head and neck; and the user returning to a standing position while keeping the weight behind the head and neck.

11. A method of exercise using the weight of claim 1 comprising the steps of:

the user, in a supine position, grasping each of the hand grips of the weight with a respective hand;

placing the weight behind the head and neck such that the user's neck rests within and is in contact with the concave curve of the front face of the body;

the user performing a sit-up movement to position the user's upper body in a raised position while keeping the weight in contact with the head and neck; and the user returning to a lowered position while keeping the weight in contact with the head and neck.

12. A method of exercise using the weight of claim 1 comprising the steps of:

the user, in a supine position, grasping each of the hand grips of the weight with a respective hand;

the user positioning the weight above the chest area and performing a pressing movement to position the weight in a raised position above the chest; and the user returning the weight to a lowered position above the chest.

13. A method of exercise using the weight of claim 1 comprising the steps of:

the user, in a standing position, grasping each of the hand grips of the weight with a respective hand;

positioning the weight above the head in an uppermost position, wherein the arms are extended substantially upward; and moving the weight in a downward path by lowering the weight to a lower position between the legs, wherein the arms are substantially extended downward and the knees are bent and then raising the weight to the uppermost position.

* * * * *